US012551086B2

(12) United States Patent
Sahlén et al.

(10) Patent No.: US 12,551,086 B2
(45) Date of Patent: Feb. 17, 2026

(54) DISHWASHER DETERGENT DISPENSER ARRANGEMENT

(71) Applicant: Gorenje d.o.o., Velenje (SI)

(72) Inventors: Karl Anders Sahlén, Grästorp (SE); Alen Zavolovšek, Velenje (SI)

(73) Assignee: Gorenje d.o.o., Velenje (SI)

( * ) Notice: Subject to any disclaimer, the term of this patent is extended or adjusted under 35 U.S.C. 154(b) by 32 days.

(21) Appl. No.: 18/573,876

(22) PCT Filed: Jun. 27, 2022

(86) PCT No.: PCT/EP2022/067540
§ 371 (c)(1),
(2) Date: Dec. 22, 2023

(87) PCT Pub. No.: WO2023/274943
PCT Pub. Date: Jan. 5, 2023

(65) Prior Publication Data

US 2024/0315525 A1 Sep. 26, 2024

(30) Foreign Application Priority Data

Jun. 28, 2021 (SE) ..... 2150822-1

(51) Int. Cl.
*A47L 15/44* (2006.01)

(52) U.S. Cl.
CPC ..... *A47L 15/4418* (2013.01); *A47L 15/4445* (2013.01); *A47L 15/4463* (2013.01); *A47L 15/449* (2013.01)

(58) Field of Classification Search
None
See application file for complete search history.

(56) References Cited

U.S. PATENT DOCUMENTS 5,176,297 A 1/1993 Mooney et al.
7,845,361 B1 12/2010 Verespej et al.
(Continued)

FOREIGN PATENT DOCUMENTS

DE 3812109 A1 10/1989
DE 102005062479 A1 7/2007
(Continued)

OTHER PUBLICATIONS

International Search Report and Written Opinion for Application No. PCT/EP2022/067540, dated Oct. 19, 2022.
(Continued)

*Primary Examiner* — Levon J Shahinian
(74) *Attorney, Agent, or Firm* — MARSHALL, GERSTEIN & BORUN LLP

(57) ABSTRACT

The invention concerns a dishwasher machine comprising: a washing chamber delimited by top, bottom and wall surfaces; a door that when closed provides one of the delimiting wall surfaces and when open provides access to the washing chamber; and a detergent dispenser arrangement for dispensing fluid detergent, such as liquid or gel detergent, into the washing chamber during operation of the dishwasher machine, wherein the detergent dispenser arrangement is arranged on one of the wall surfaces and comprises a supply container for the fluid detergent and further comprises a transfer mechanism for transferring fluid detergent from the supply container into the washing chamber and wherein the supply container is adapted to be detachably attachable to the detergent dispenser arrangement. The transfer mechanism comprises a pump unit arranged in fluid communication with the washing chamber and the supply container.

14 Claims, 11 Drawing Sheets

(56) References Cited

U.S. PATENT DOCUMENTS

| | | | |
|---|---|---|---|
| 7,931,032 | B1 | 4/2011 | Penkauskas et al. |
| 2007/0193609 | A1 | 8/2007 | Classen et al. |
| 2009/0194562 | A1 | 8/2009 | Kessler et al. |
| 2010/0000580 | A1 | 1/2010 | Classen et al. |
| 2016/0143503 | A1 | 5/2016 | Kan et al. |
| 2017/0042404 | A1 | 2/2017 | Kan et al. |
| 2020/0008646 | A1 | 1/2020 | Marone |

FOREIGN PATENT DOCUMENTS

| | | | |
|---|---|---|---|
| DE | 102006026800 | A1 | 12/2007 |
| DE | 102006043915 | A1 | 3/2008 |
| DE | 102010003771 | A1 | 10/2011 |
| EP | 3130272 | B1 | 8/2016 |
| WO | WO-2018163058 | A1 | 9/2018 |

OTHER PUBLICATIONS

Swedish Search Report for application No. 2150822-1, dated Jun. 28, 2021.

DISHWASHER DETERGENT DISPENSER ARRANGEMENT

TECHNICAL FIELD

This invention relates to a dishwasher machine comprising a detergent dispenser arrangement for dispensing fluid detergent, such as liquid or gel detergent. The invention also relates to a detergent dispenser arrangement.

BACKGROUND OF THE INVENTION

Dishwasher detergent dispenser arrangements that provide for a controlled supply of detergent during operation of the dishwasher are known from, for instance, EP3130272B1 and WO2018/163058. Such dispenser arrangements are useful for adapting the amount of detergent to the particular load of dishes to be cleaned or at least to the particular washing program selected by a user. More detergent than typically used may be needed to clean a particularly large or particularly dirty dish load and less detergent may be needed for other dish loads. How much detergent to dispense during operation of the dishwasher may be controlled by a dish washer control system. A fluid detergent, such as liquid or gel detergent, may be used in the dispenser arrangements of the above type.

Controllable detergent dispenser arrangements using a fluid detergent are provided with a supply container for the fluid detergent and some form of transfer mechanism for transferring the detergent from the supply container into a washing chamber of the dishwasher. Compared to conventional dishwashers where a portion of detergent (in the form of powder or a block) is placed in a compartment below a lid, which only requires opening of the lid to supply the detergent to the washing chamber, the fluid detergent transfer mechanism is a more complicated structure involving some form of dosing system that in turn typically includes various controllable moving parts, a driver unit for driving the moving parts, etc. Such transfer mechanisms are more likely than the lids of conventional dishwashers to malfunction due to wear, lack of aging-resistance, objects plugging up flow channels, etc.

SUMMARY OF THE INVENTION

An object of this invention to provide a dishwasher detergent dispenser arrangement for dispensing fluid detergent that exhibits improved properties with regard to durability and service compared to known dispenser arrangements of the same type. This object is achieved by the dishwasher machine and detergent dispenser arrangement defined by the technical features contained in the corresponding independent claim. The dependent claims contain advantageous embodiments, further developments and variants of the invention.

The invention concerns a dishwasher machine comprising: a washing chamber delimited by top, bottom and wall surfaces; a door that when closed provides one of the delimiting wall surfaces and when open provides access to the washing chamber; and a detergent dispenser arrangement for dispensing fluid detergent, such as liquid or gel detergent, into the washing chamber during operation of the dishwasher machine, wherein the detergent dispenser arrangement is arranged on one of the wall surfaces and comprises a supply container for the fluid detergent and further comprises a transfer mechanism for transferring fluid detergent from the supply container into the washing chamber. The supply container is adapted to be detachably attachable to the detergent dispenser arrangement. The dispenser arrangement is preferably arranged on an inside of the door since this provides for a more easy access for a user compared to if the dispenser arrangement is arranged on one of the other walls of the washing chamber.

Further, the transfer mechanism comprises a pump unit arranged in fluid communication with the washing chamber and the supply container when the supply container is attached to the detergent dispenser arrangement, wherein the supply container is adapted to be detachably attachable to the pump unit so that the supply container can be detached and removed without detaching and removing the pump unit, and wherein the pump unit is detachably attached to the detergent dispenser arrangement so that, at least when the supply container is detached and removed from the detergent dispenser arrangement, the pump unit is accessible for detachment and removal from the detergent dispenser arrangement.

Accordingly, the supply container forms a separate removable component, which makes it easy for a user to refill the container and put it back in the dishwasher. Besides the supply container also the pump unit forms a separate component that may be removed if needed. The pump unit can thus easily be exchanged, repaired or cleaned in case of malfunction. Pump units typically contain parts that might be worn or with time exhibit impaired properties, such as reduced flexibility or capability to prevent leakage, and the pump unit might therefore need to be replaced after some time. It might also be that malfunction is a result of a user having introduced powder or other unsuitable type of detergent in the detergent supply container. In any case, the inventive design simplifies exchange, repair and cleaning of the pump unit as it can easily be removed as a separate component, which is contrast to detergent dispenser arrangements where the pump unit forms an integrated part. As to exchange, a particular advantage is that only the pump unit needs to be replaced by a new one, no other component needs to be replaced. The removed pump unit may, however, include one or more parts of e.g. a pump driver depending on the detailed structure of the detachable attachment to the detergent dispenser arrangement.

In an embodiment, the detergent dispenser arrangement is arranged in association with a housing compartment having a bottom, side walls and an at least partly open side opposite the bottom, wherein the housing compartment is arranged on one of the washing chamber wall surfaces with the partly open side facing outwards the wall surface and facing inwards the washing chamber, and wherein the supply container is adapted to be at least partly inserted into the housing compartment via the partly open side thereof and be detachably attached to the housing compartment.

The housing compartment may be a space formed in one of the wall surfaces of the dishwasher (including the door wall surface) or may be a separate housing unit arranged in an opening in one of said wall surfaces.

In an embodiment, the pump unit is arranged at the bottom of the housing compartment behind the supply container when the supply container is attached to the housing compartment. Although the fluid connection between the supply container and the pump unit may be arranged in different ways, placing the pump unit at the bottom below/behind the intended position of the supply container is useful for establishing a connection when the supply container is fitted and inserted into the housing compartment and moved in a direction straight towards the pump unit. As explained below, an example of how to establish the fluid connection is to let a pipe section be inserted into an opening during the controlled movement of the supply container towards the pump unit.

In an embodiment, the housing compartment forms a separate housing unit that is arranged in an opening in one of the washing chamber wall surfaces.

In an embodiment, the fluid communication between the pump unit and the supply container is provided by means of a pipe section and an opening adapted to receive the pipe section, wherein the pipe section is arranged on the pump unit or the supply container and the receiving opening is arranged on the other of the pump unit and the supply container so that fluid detergent is allowed to flow from the supply container into the pump unit through the pipe unit.

The pipe section-opening connection arrangement is preferably configured to seal the connection between the pipe section and the receiving opening; it may thus comprise one or more separate sealing elements, such as an O-ring arranged around the pipe section or inside the opening.

As mentioned above, such a pipe section-opening connection arrangement for the fluid communication between the pump unit and the supply container is particularly useful for "automatically" establish the connection while moving the supply container in a controlled direction towards the pump unit when attaching the supply container.

In an embodiment, the pipe section is directed in such a way, and wherein the pipe section and the receiving opening are positioned in relation to each other in such a way, that when the supply container is attached to the detergent dispenser arrangement, the pipe unit is inserted into the receiving opening so as to provide for the fluid communication between the supply container and the pump unit. By adapting the shapes of the supply container and a receiving space for the supply container in the dispenser arrangement/housing compartment so that the supply container fits reasonably tightly into the receiving space, the position of the pipe section in relation to the receiving opening can be controlled while the supply container is inserted into the receiving space when attaching the supply container.

In an embodiment, the pipe section is arranged on the pump unit and forms an inlet of the pump unit, and wherein the receiving opening is arranged on the supply container and forms an outlet of the supply container. The supply container may then be free from any pipe sections or other protruding objects. This also simplifies providing a spring-biased sealing member at the outlet of the supply container, which is further described below.

Whatever the form of the outlet of the supply container, the outlet is preferably arranged in a lower part of the container (where "lower" refers to the situation when the dishwasher door is closed if the dispenser arrangement is arranged in the door) so that gravity does not force the detergent to flow away from the outlet during operation of the dishwasher.

In an embodiment, the pump unit is a peristaltic pump comprising a flexible tube forming a fluid connection between an inlet and an outlet of the pump unit, the pump unit further comprising a rotor provided with a plurality of pump elements arranged to compress the flexible tube and provide a flow of fluid detergent when the rotor rotates. A pump unit of this kind is efficient, easy to control and believed to be durable in the application in question. Nevertheless, the tube may sometime start to leak or lose its flexibility, or some form of object may prevent flow through the pump unit, so it is an advantage with regard to service that the pump unit can be detached and removed from the detergent dispenser arrangement for e.g. cleaning or exchange.

In an embodiment, the transfer mechanism further comprises a pump driver arranged to drive the pump unit so as to transfer fluid detergent from the supply container into the washing chamber.

In an embodiment, the transfer mechanism comprises a rotatable drive shaft operatively connected to the pump driver and to the pump unit for driving of the pump unit, wherein the drive shaft is arranged to be disconnectable so that the pump unit can be disconnected from the pump driver. The drive shaft may be arranged so that it can be disconnected from either or both of the pump driver and the pump unit or it can be constituted of several parts that can be disconnected from each other.

In an embodiment, the drive shaft comprises a first part connected to the pump driver and a second part connected to the pump unit, and wherein the first and second drive shaft parts are connectable so as to be rotationally fixed to each other.

In an embodiment, the pump driver comprises an electric motor and, optionally, one or more gear drives.

Various pump units may be used as an alternative to the peristaltic pump, for instance various rotary positive-displacement pumps, that besides peristaltic pumps include e.g. pumps with pump wheels such as an impeller, or various reciprocating positive-displacement pumps, such as piston or plunger pumps. A transfer mechanism comprising a reciprocating piston or plunger pump may be provided with a solenoid (connected to a source of electric current) for driving of the piston/plunger pump. Such a transfer mechanism would typically not include any rotatable drive shaft. In such a case it may be arranged so that the detachable and removable pump unit may or may not include the piston/plunger and/or the solenoid, i.e. the piston/plunger and/or the solenoid may be secured to a pump housing or similar of the pump unit so as to follow the pump unit when detaching and removing the pump unit, or the piston/plunger and/or the solenoid may be secured to the dishwasher machine/detergent dispenser arrangement so as to remain in the dishwasher machine when detaching and removing the pump unit.

A peristaltic pump is in any case considered to be a very suitable choice as it is reliable and provides for easy and exact control of the amount (dose) of detergent to be dispensed into the washing chamber, for instance because it is relatively insensitive to the viscosity of the fluid detergent.

In an embodiment, the pump unit is a rotary positive-displacement pump. This includes several types of pumps, such as peristaltic pumps, impeller pumps, rotary vane pumps, lobe pumps, etc. Preferably, the transfer mechanism comprises a rotatable drive shaft operatively connected to the pump driver and to the rotary positive-displacement pump unit for driving of the pump unit, wherein, as also mentioned above, the drive shaft is arranged to be disconnectable so that the pump unit can be disconnected from the pump driver.

In an embodiment, the pump driver is arranged on a back side of the bottom of the housing compartment, wherein a drive shaft operatively connected to the pump driver and the pump unit extends through the bottom of the housing compartment. The pump driver and the pump unit can thus be located close to each other but on opposite sides of the bottom of the housing compartment. This provides for a relatively simple driving connection and the pump driver is well protected behind the compartment bottom. The pump driver may be arranged in other positions.

In an embodiment, the pump unit is detachably attached to the detergent dispenser arrangement by means of a releasable connection mechanism, such as a snap-fit connection, a bayonet connection, a screw connection, etc. In contrast to the supply container, the pump unit is likely to be disconnected only very rarely so the releasable connection structure does not have to provide for a very quick and easy disconnection and connection.

In an embodiment, the fluid communication between the pump unit and the washing chamber is provided by means of a channel through the supply container, wherein a first end of the channel connects to an outlet of the pump unit and a second end of the channel is open to the washing chamber when the supply container is attached to the detergent dispenser arrangement. The outlet of the pump unit may include a pipe section that can connect to the first end of the channel when attaching the supply container in a similar way as described above for the connection between the supply container and the inlet of the pump unit.

In an embodiment, a spring-biased sealing member is arranged at an outlet of the supply container. This prevents remaining detergent to flow out from the supply container when the supply is removed from the detergent dispenser arrangement.

The invention also concerns a detergent dispenser arrangement for dispensing fluid detergent, such as liquid or gel detergent, into a washing chamber of a dishwashing machine during operation of the dishwasher machine, wherein the detergent dispenser arrangement comprises a housing compartment having a bottom, side walls and an at least partly open side opposite the bottom, wherein the housing compartment is adapted to be arranged in an opening on a wall surface that delimits a washing chamber in the dishwashing machine with the partly open side facing outwards the wall surface and facing inwards the washing chamber, wherein the detergent dispenser arrangement comprises a supply container for the fluid detergent and further comprises a transfer mechanism for transferring fluid detergent from the supply container into the washing chamber, wherein the supply container is adapted to be at least partly inserted into the housing compartment via the partly open side thereof and be detachably attached to the housing compartment, wherein the transfer mechanism comprises a pump unit arranged in fluid communication with the washing chamber and the supply container when the supply container is attached to the housing unit, wherein the transfer mechanism further comprises a pump driver arranged to drive the pump unit so as to transfer fluid detergent from the supply container into the washing chamber, wherein the supply container is adapted to be detachably attachable to the pump unit so that the supply container can be detached and removed without detaching and removing the pump unit, and wherein the pump unit is detachably attached to the housing compartment so that, at least when the supply container is detached and removed from the housing compartment, the pump unit is accessible for detachment and removal from the detergent dispenser arrangement.

Such a detergent dispenser arrangement forms a separate unit that can be arranged in an opening on a wall surface of a washing chamber of a dishwasher machine. This is an alternative to configuring the wall surface so that it provides the housing compartment as a part of the wall surface.

In an embodiment of the detergent dispenser arrangement, the pump unit is arranged at the bottom of the housing compartment behind the supply container when the supply container is attached to the housing compartment.

In an embodiment of the detergent dispenser arrangement, the pump driver is arranged on a back side of the bottom of the housing compartment, wherein a drive shaft operatively connected to the pump driver and the pump unit extends through the bottom of the housing compartment.

BRIEF DESCRIPTION OF DRAWINGS

In the description of the invention given below reference is made to the following figure, in which.

DESCRIPTION OF EXAMPLE EMBODIMENTS OF THE INVENTION

An embodiment of a detergent dispenser arrangement arranged in a dishwasher will now be described with reference to FIGS. 1-8*c*.

Figure 1:
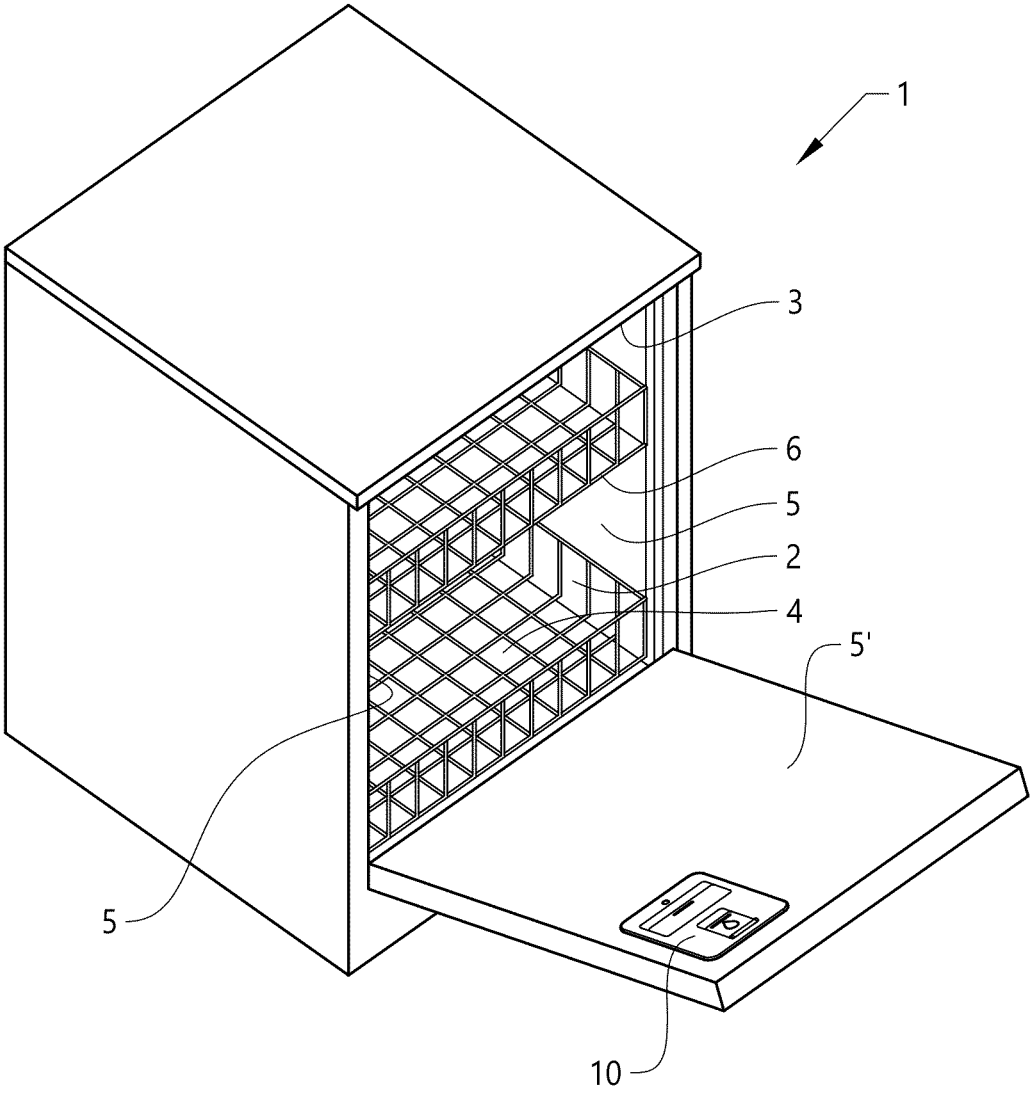
FIG. 1 shows a dishwasher machine provided with a detergent dispenser arrangement according to an embodiment of the invention.

FIG. 1 shows a dishwasher machine 1 provided with detergent dispenser arrangement 10 according to an embodiment of the invention. An inner washing chamber 2 of the dishwasher 1 is defined by top 3, bottom 4 and wall surfaces 5. A door 5' provides one of the delimiting wall surfaces 5, 5' when closed and provides access to the washing chamber 2 when open. The detergent dispenser arrangement 10 is arranged to dispense fluid detergent, such as liquid or gel detergent, into the washing chamber 2 during operation of the dishwasher machine 1. In this case the detergent dispenser arrangement 10 is arranged in an opening of an inner wall surface of the door 5'.

Upper and lower extractable and retractable basket/wire racks 6 for supporting goods to be cleaned are arranged between sidewalls of the dishwasher 1. The dishwasher 1 is typically provided with further components, such as spray arms, water recirculation system, control system, etc. Such further components are well known and not shown in FIG. 1.

The detergent dispenser arrangement 10 comprises a supply container 11 for the fluid detergent and further comprises a transfer mechanism 14, 16 for transferring fluid detergent from the supply container 11 into the washing chamber 2.

Figure 3:
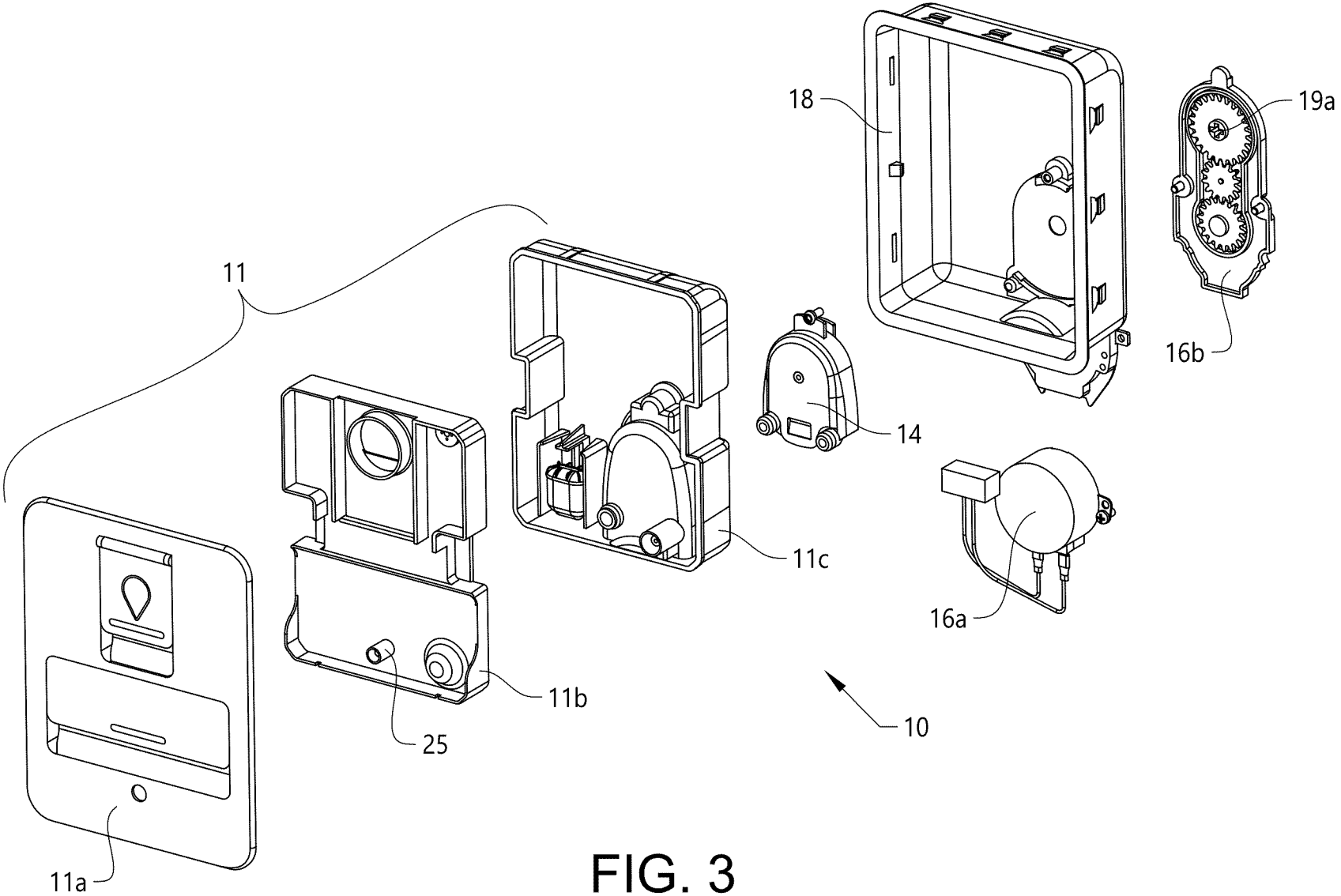
FIG. 3 shows an exploded view of the detergent dispenser arrangement according to FIG. 1.
Figure 7A:
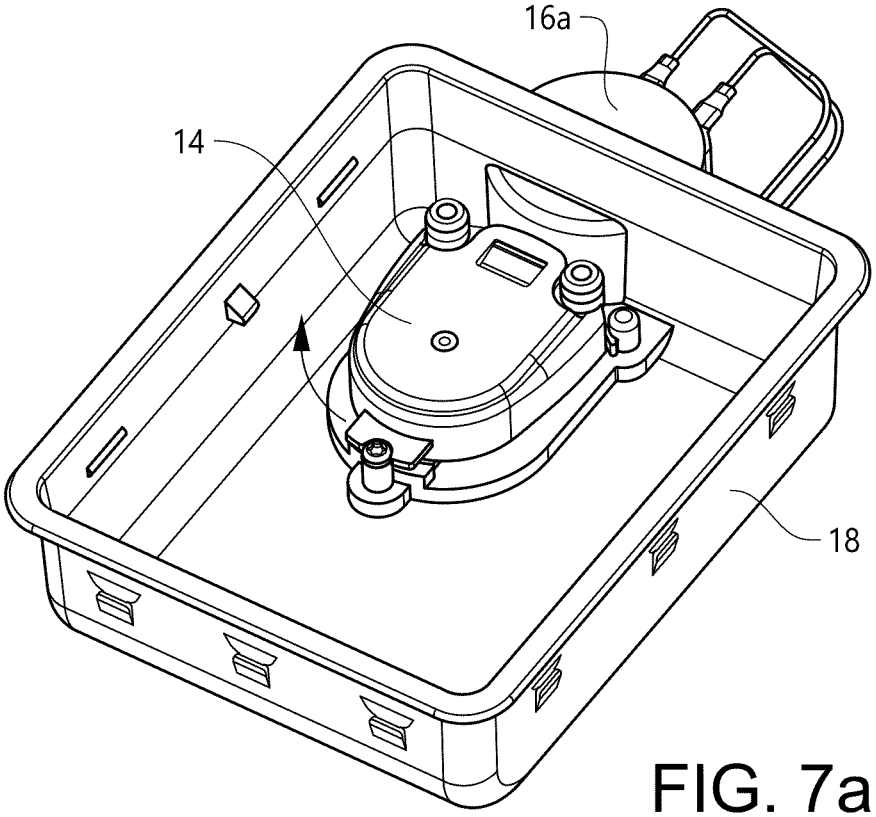
FIGS. 7*a*-7*c* show detachment of a pump unit of the detergent dispenser arrangement according to FIG. 1.
Figure 7B:
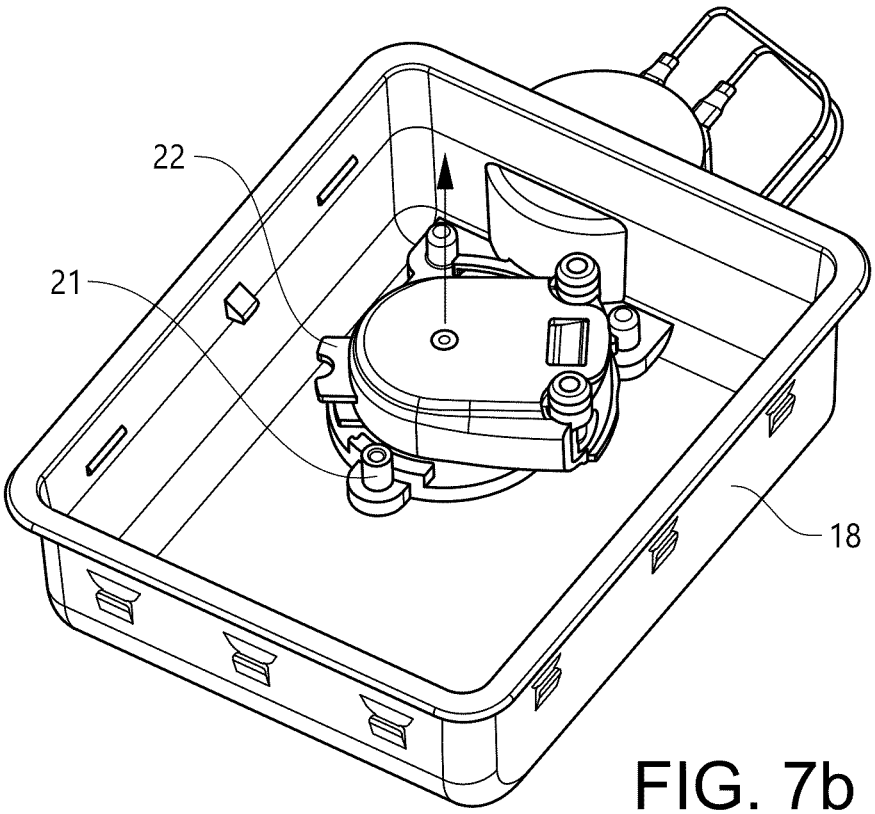
Figure 7C:
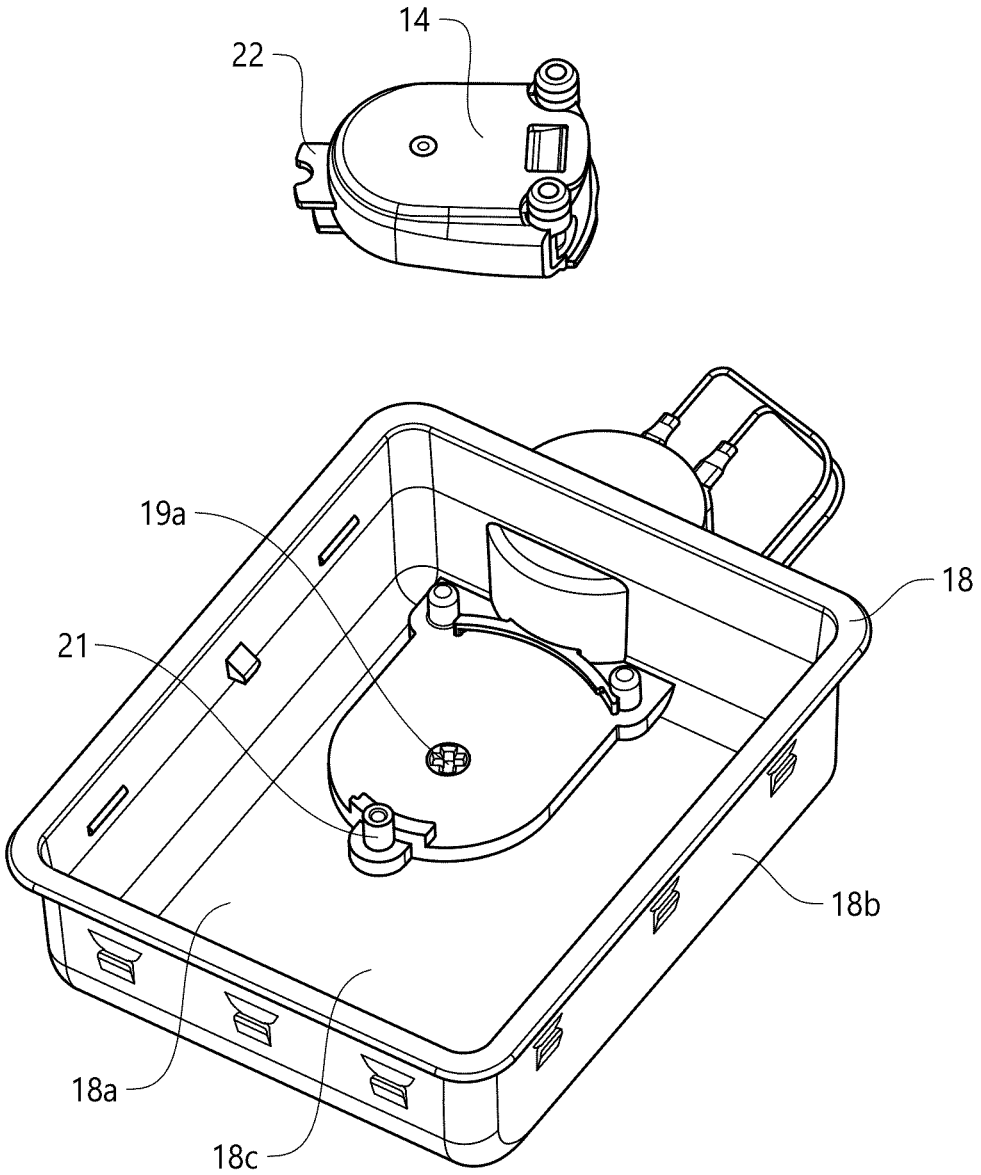

The detergent dispenser arrangement 10 further comprises a housing compartment 18 having a bottom 18*a*, side walls 18*b* and an at least partly open side 18*c* opposite the bottom 18*a* (see e.g. FIGS. 3 and 7*c*). The housing compartment 18 forms in this case a separate housing unit that is arranged in an opening in the wall surface of the door 5' with the partly open side 18*c* facing outwards from the door wall surface 5' and facing inwards the washing chamber 2.

The supply container 11 is adapted to be at least partly inserted into the housing compartment 18 via the partly open side 18*c* thereof and be detachably attached to the housing compartment 18. A handle 13 (see FIG. 2*a*) is used to release the supply container 11 from the housing compartment 18. A lid 12 covers an opening through which detergent can be introduced for refill of the supply container 11.

The transfer mechanism comprises a pump unit 14 arranged in fluid communication with the washing chamber 2 and the supply container 11 when the supply container 11 is attached to the detergent dispenser arrangement 10. The transfer mechanism further comprises a pump driver 16 arranged to drive the pump unit 14 so as to transfer fluid detergent from the supply container 11 into the washing chamber 2.

As described more in detail below, the supply container 11 is adapted to be detachably attachable to the pump unit 14 so that the supply container 11 can be detached and removed without detaching and removing the pump unit 14. Further, the pump unit 14 is detachably attached to the detergent dispenser arrangement 10 so that, when the supply container 11 is detached and removed from the detergent dispenser arrangement 10 (see FIGS. 7*a*-7*c*), the pump unit 14 is accessible for detachment and removal from the housing compartment 18 and thus from the detergent dispenser arrangement 10. The pump unit 14 is in this case arranged at the bottom 18*a* of the housing compartment 18 behind the supply container 11 when the supply container 11 is attached to the housing compartment 18.

Figure 4:
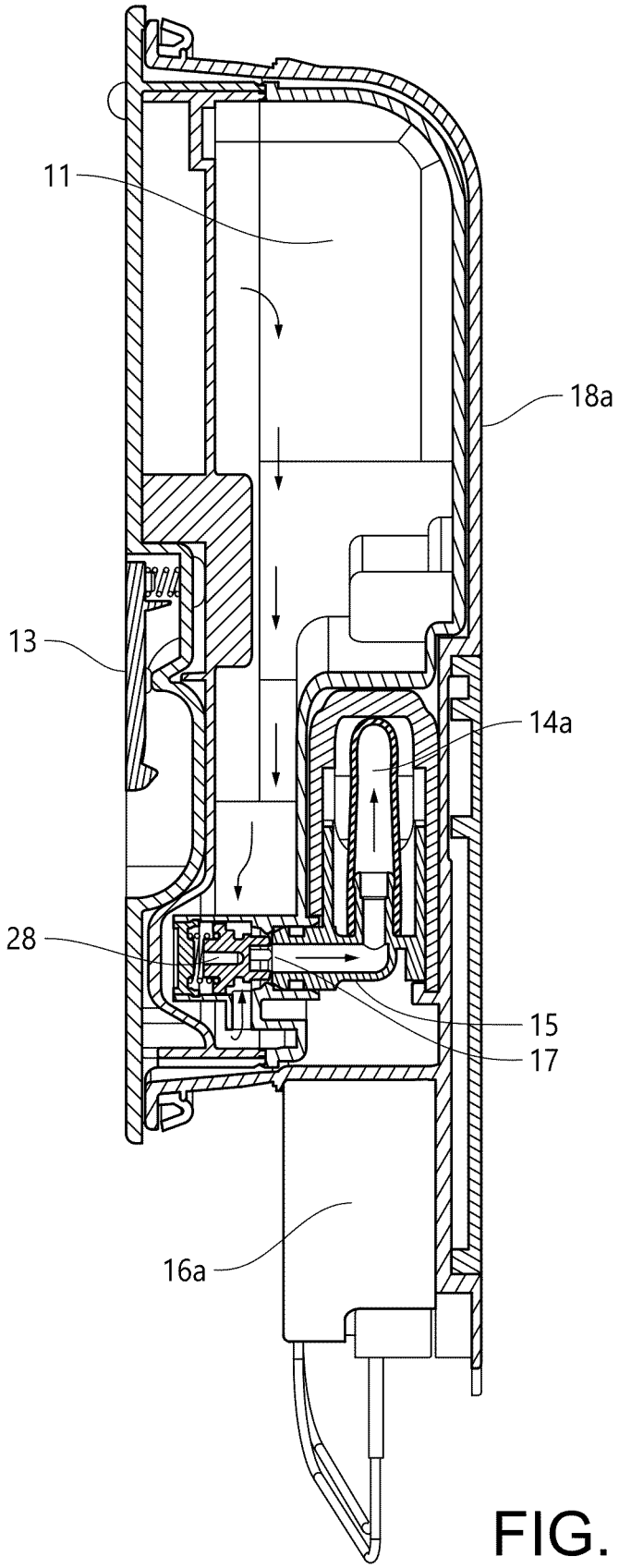
FIG. 4 shows a first cross section of the detergent dispenser arrangement according to FIG. 1.

As shown in FIG. 4, the fluid communication between the pump unit 14 and the supply container 11 is provided by means of a pipe section 15 and an opening 17 adapted to receive the pipe section 15. The pipe section 15 is in this case arranged on the pump unit 14 and the receiving opening 17 is arranged on the supply container 11 so that fluid detergent is allowed to flow from the supply container 11 into the pump unit 14 through the pipe section 15. The pipe section 15 forms an inlet of the pump unit 14 and the receiving opening 17 forms an outlet of the supply container (11).

The pipe section 15 is directed in such a way, i.e. straight towards the supply container 11, and the pipe section 15 and the receiving opening 17 are positioned in relation to each other in such a way, i.e. they are aligned with each other, that when the supply container 11 is attached to the detergent dispenser arrangement 10, i.e. when the supply container 11 is inserted into the housing compartment 18 and moved towards the bottom 18*a* of the housing compartment 18, the pipe section 15 is inserted into the receiving opening 17 so as to provide for the fluid communication between the supply container 11 and the pump unit 14. An O-ring may be arranged around the pipe section 15 so as to seal towards an annular inner side of the opening 17.

Figure 5:
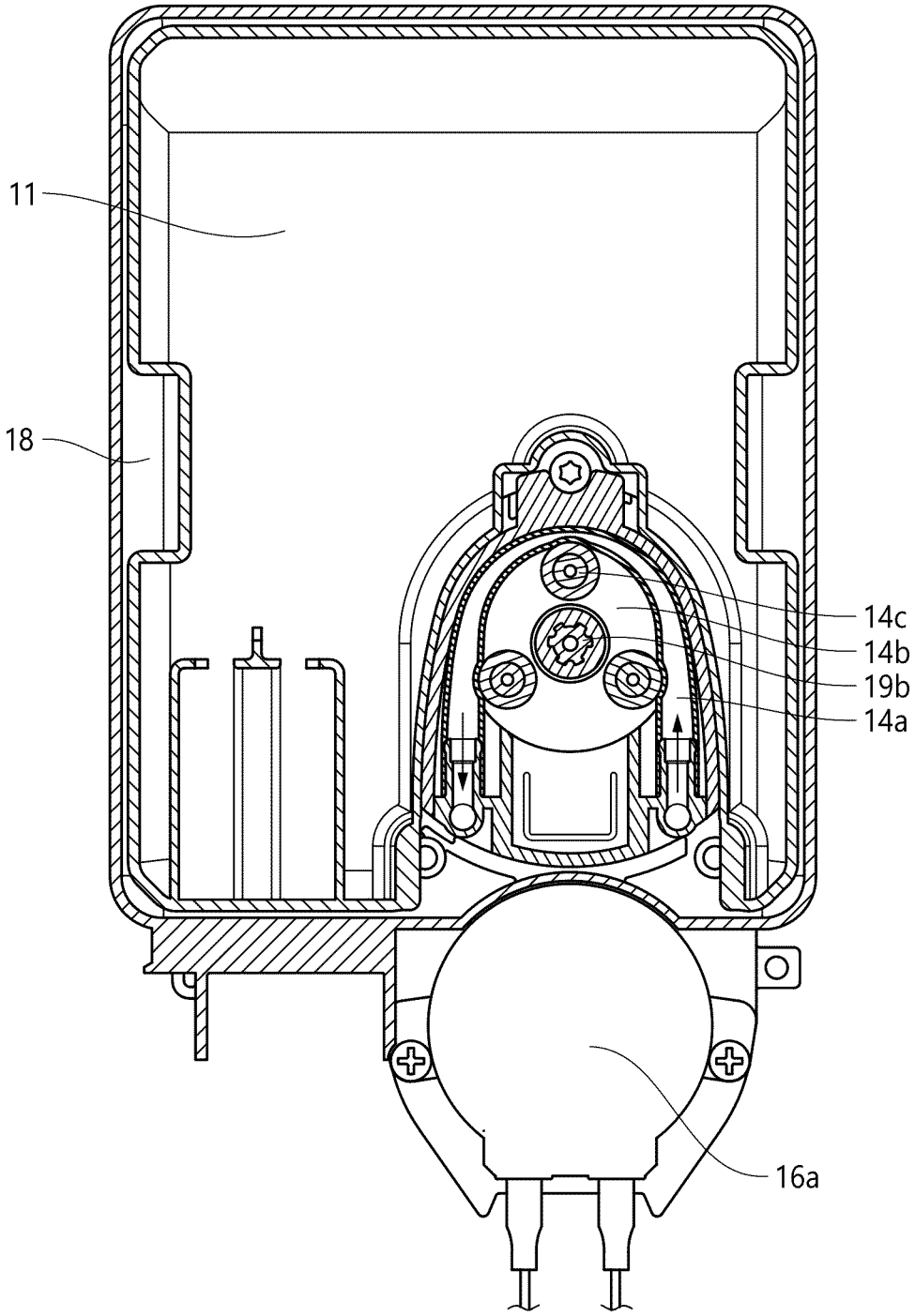
FIG. 5 shows a second cross section of the detergent dispenser arrangement according to FIG. 1.

As shown in e.g. FIG. 5, the pump unit 14 is a peristaltic pump comprising a flexible tube 14*a* forming a fluid connection between an inlet (pipe section 15) and an outlet (pipe section 26, see e.g. FIG. 9) of the pump unit 14. The pump unit 14 further comprises a rotor 14*b* provided with a plurality of pump/roller elements 14*c* arranged to compress the flexible tube 14*a* and provide a flow of fluid detergent when the rotor 14*b* rotates.

Figure 8A:
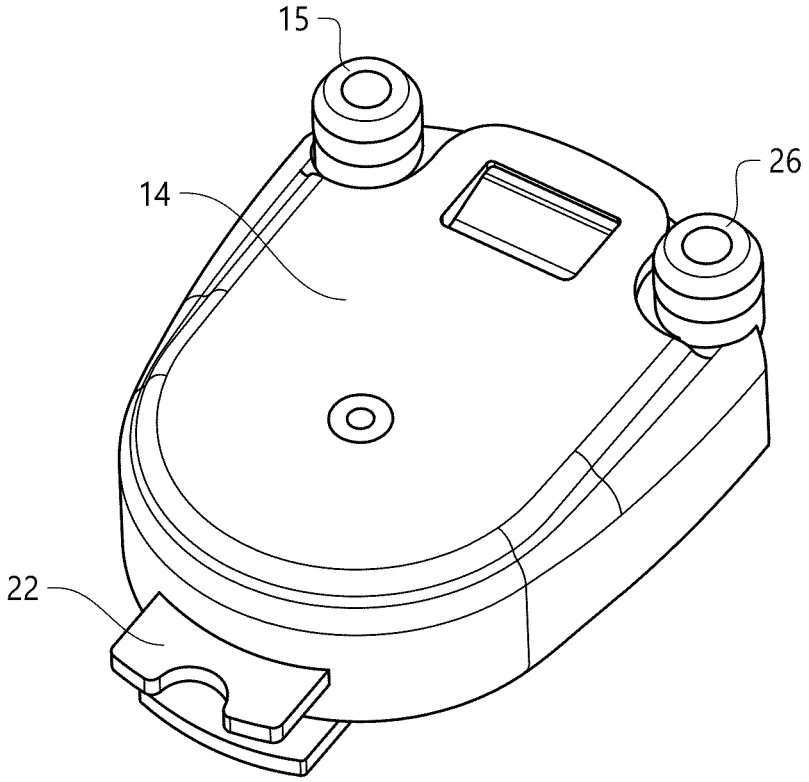
FIGS. 8*a*-8*c* show different views of the pump unit according to FIGS. 7*a*-7*c*.
Figure 8B:
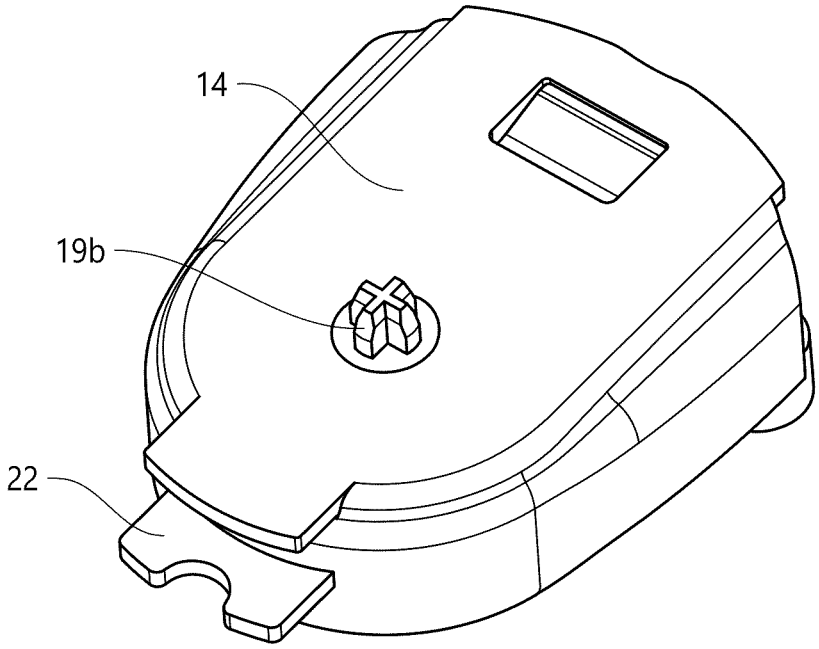
Figure 8C:
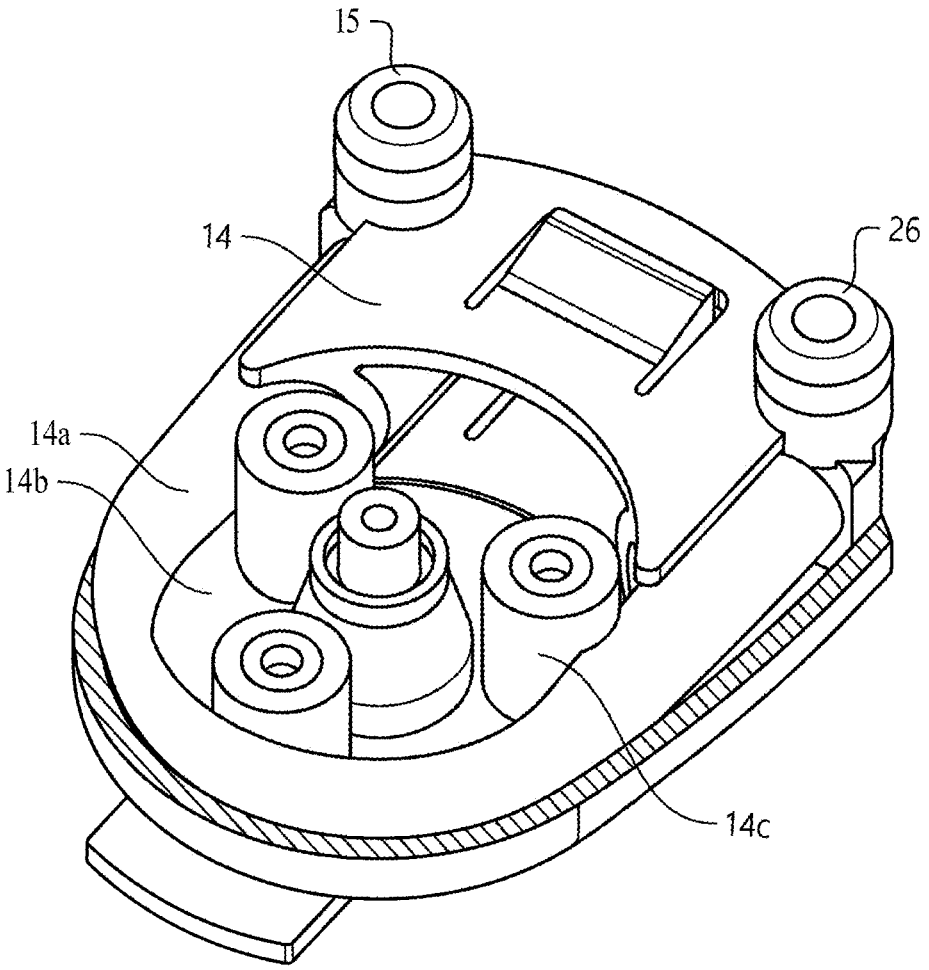

A rotatable drive shaft 19*a*, 19*b* is operatively connected to the pump driver 16 and to the pump unit 14 for driving of the pump unit 14. The drive shaft 19*a*, 19*b* is arranged to be disconnectable so that the pump unit 14 can be disconnected from the pump driver 16. In this case this disconnection is achieved in that the drive shaft comprises a first part 19*a* connected to the pump driver 16 and a second part 19*b* connected to the pump unit 14, and wherein the first and second drive shaft parts 19*a*, 19*b* are connectable so as to be rotationally fixed to each other. As shown in FIGS. 7*c* and 8*b*, the disconnection and rotational fixation is arranged by giving an end portion of the second part 19*b* of the drive shaft a cross section having an X– or +-shape and by giving an end portion of the first part 19*a* of the drive shaft a corresponding cross section configured to receive the end portion of the second part 19*b*. When the two end portion are fitted together, the first and second drive shaft parts 19*a*, 19*b* are rotationally fixed to each other. Other cross sections could be used of course. As an alternative to the use of a dividable drive shaft, it is possible to provide for disconnection (and connection) of the entire drive shaft from one or both of the pump driver 16 and the pump unit 14.

As shown in e.g. FIG. 3, the pump driver 16 comprises an electric motor 16*a* and, in this case, three gear wheels 16*b* connecting the motor 16*a* with (the first part 19*a*) of the drive shaft.

Figure 2A:
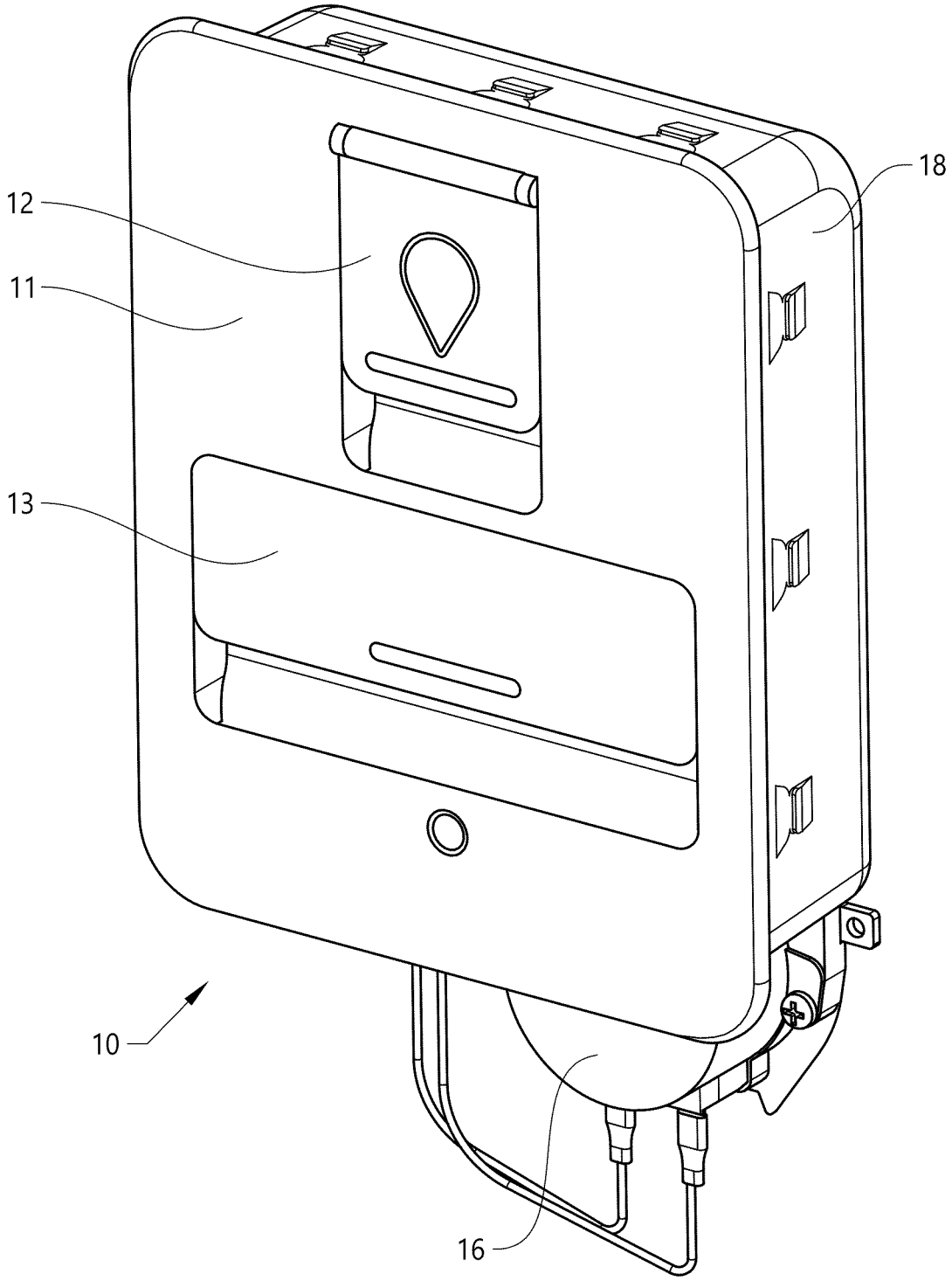
FIG. 2*a* shows, in a perspective view, a front side of the detergent dispenser arrangement according to FIG. 1.
Figure 2B:
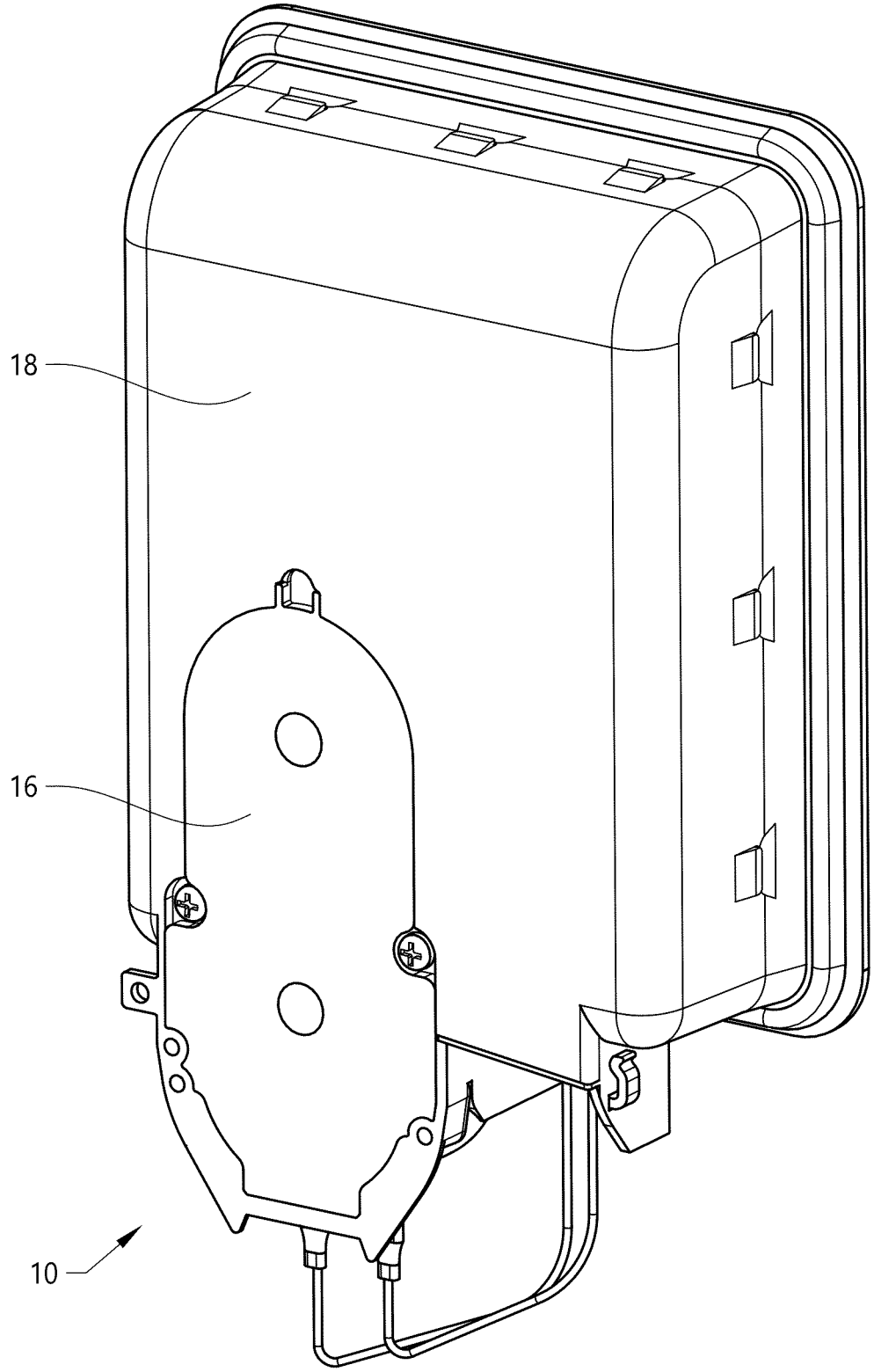
FIG. 2*b* shows, in a perspective view, a back side of the detergent dispenser arrangement according to FIG. 1.

As shown in e.g. FIG. 2*b*, the pump driver 16 is arranged on a back side of (and partly below) the bottom 18*a* of the housing compartment 18. The drive shaft 19*a*, 19*b* extends through the bottom 18*a* of the housing compartment 18.

FIGS. 7*a*-7*c* show that the pump unit 14 is detachably attached to the detergent dispenser arrangement 10 by means of a releasable connection structure comprising a pin 21 arranged on the housing compartment 18 and a pin-receiving element 22 arranged on the pump unit. The releasable connection structure is in this example a snap-fit connection where rotation of the pump unit 14 allows for release of the pump unit 14 from the housing compartment 18 as shown in FIGS. 7*a*-7*c*. Attachment of the pump unit 14 (which may a new pump unit if the former one does not work properly) is carried out in the same manner as detachment, i.e. the pump unit 14 is properly placed into the housing compartment 18 with the two drive shaft parts 19*a*, 19*b* properly connected (as in FIG. 7*b*), and then the pump unit 14 is rotated so that the pin 21 snap-fits into the pin-receiving element 22 (as in FIG. 7*a*). Other possible releasable connections are, for instance, a bayonet connection or a screw connection, etc.

Figure 6:
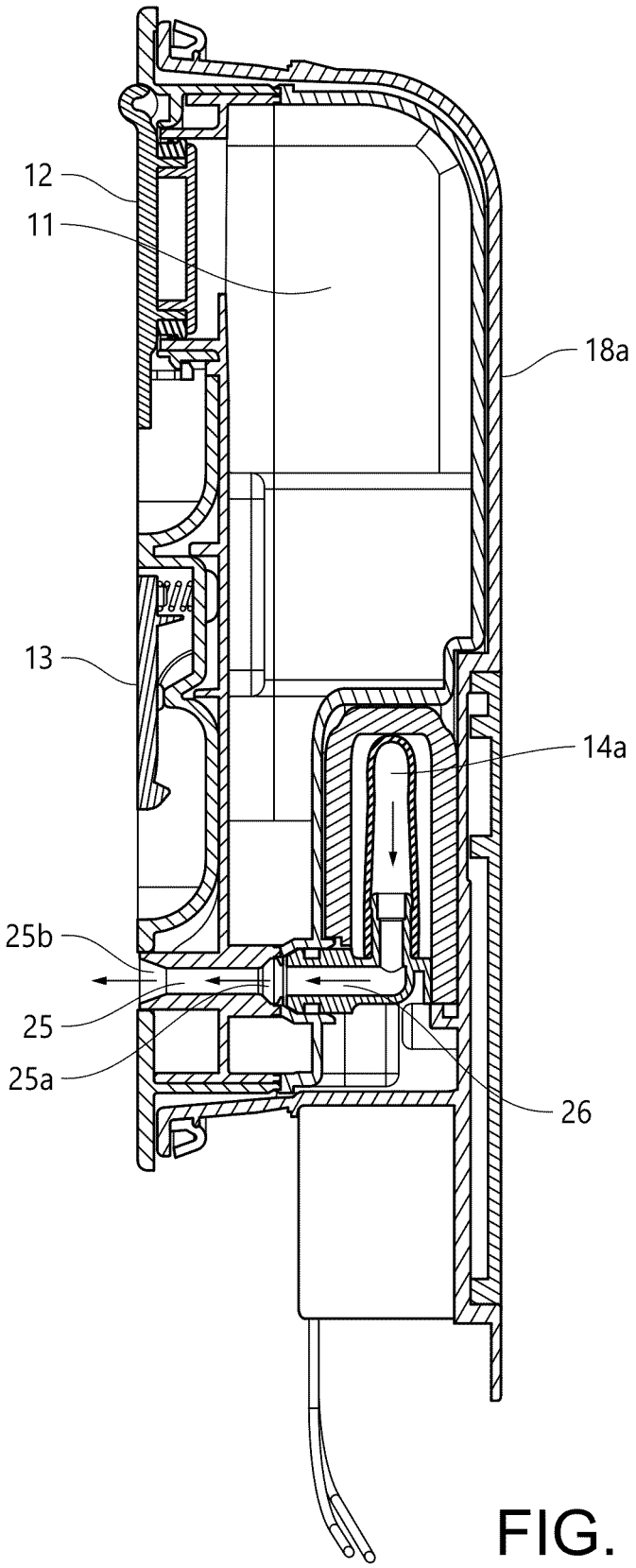
FIG. 6 shows a third cross section of the detergent dispenser arrangement according to FIG. 1.

As shown in FIG. 6, the fluid communication between the pump unit 14 and the washing chamber 2 is provided by means of a channel 25 through the supply container 11. A first end 25*a* of the channel 25 connects to the outlet 26 of the pump unit 14 and a second end 25*b* of the channel 25 is open to the washing chamber 2 when the supply container 11 is attached to the detergent dispenser arrangement 10 and thus to the compartment housing 18. The pump unit outlet 26 forms a pipe section similar to the pipe section 15 forming the inlet of the pump unit 14.

As shown in FIG. 4, a spring-biased sealing member 28 is arranged at the outlet 17 of the supply container 11. The outlet 17 then becomes closed when the supply container 11 is removed from the housing compartment 18.

Control of the detergent dispenser arrangement 10, i.e. control of the pump driver 16, can be achieved by a dishwasher control system that is used also for controlling the different washing programs etc. Timing and amounts of detergent to be dispensed may be controlled depending on operation program chosen by user and/or signal from sensor configured to sense level of dirt in the washing water.

When the electric motor 16*a* of the pump driver 16 is activated, a rotational movement is transferred via the gear drive 16*b* to the drive shaft 19*a*, 19*b*, This causes the rotor 14*b* and the roller elements 14*c* to rotate. As the roller elements 14*c* moves/rotates, they compress the flexible tube 14*a* so that fluid detergent flows, as indicated in FIG. 4, from the supply container 11, out through the opening 17 and through the pipe section 15 and into and through the flexible tube 14*a*. Further, as indicated in FIGS. 5 and 6, the detergent flows through the flexible tube 14*a*, out from the pump unit 14 via outlet/pipe section 26, through the channel 25 and out to the washing chamber 2.

The amount of fluid detergent dispensed into the washing chamber 2 is thus controlled by controlling the electric motor 16*a*.

The invention is not limited by the embodiments described above but can be modified in various ways within the scope of the claims.

FIGURE REFERENCES

1 dishwasher machine
2 washing chamber
3 top
4 bottom
5 wall
5' door
6 basket
10 detergent dispenser arrangement
11 supply container for fluid detergent
12 lid
13 handle
14 pump unit
14*a* flexible tube
14*b* rotor
14*c* roller element
15 pipe section
16 pump driver
16*a* pump motor
16*b* gear drive
17 opening for receiving pipe section 15
18 housing compartment
18*a* bottom
18*b* side wall
18*c* open side
19*a* first part of pump drive shaft
19*b* second part of pump drive shaft
21, 22 releasable connection structure (pin 21, pin-receiving element 22)
25 channel through supply container 11
26 outlet of pump unit 14

The invention claimed is:

1. Dishwasher machine comprising:

a washing chamber delimited by top, bottom and wall surfaces;

a door that when closed provides one of the delimiting wall surfaces and when open provides access to the washing chamber; and a detergent dispenser arrangement for dispensing fluid detergent, such as liquid or gel detergent, into the washing chamber during operation of the dishwasher machine, wherein the detergent dispenser arrangement is arranged on one of the wall surfaces and comprises a supply container for the fluid detergent and further comprises a transfer mechanism or transferring fluid detergent from the supply container into the washing chamber, and wherein the supply container is adapted to be detachably attachable to the detergent dispenser arrangement, characterized in that the transfer mechanism comprises a pump unit arranged in fluid communication with the washing chamber and the supply container when the supply container is attached to the detergent dispenser arrangement, wherein the supply container is adapted to be detachably attachable to the pump unit so that the supply container can be detached and removed without detaching and removing the pump unit, and wherein the pump unit is detachably attached to the detergent dispenser arrangement so that, at least when the supply container is detached and removed from the detergent dispenser arrangement, the pump unit is accessible for detachment and removal from the detergent dispenser arrangement wherein the detergent dispenser arrangement is arranged in association with a housing compartment having a bottom, side walls and an at least partly open side opposite the bottom, wherein the housing compartment is arranged on one of the washing chamber wall surfaces with the partly open side facing outwards from the wall surface and facing inwards the washing chamber, and wherein the supply container is adapted to be at least partly inserted into the housing compartment via the partly open side thereof and be detachably attached to the housing compartment and wherein the pump unit is arranged at the bottom of the housing compartment behind the supply container when the supply container is attached to the housing compartment.

2. Dishwasher machine according to claim 1, wherein the housing compartment forms a separate housing unit that is arranged in an opening in one of the washing chamber wall surfaces.

3. Dishwasher machine according to claim 2, wherein the pipe section is arranged on the pump unit and forms an inlet of the pump unit, and wherein the receiving opening is arranged on the supply container and forms an outlet of the supply container.

4. Dishwasher machine according to claim 1, wherein the fluid communication between the pump unit and the supply container is provided by means of a pipe section and an opening adapted to receive the pipe section, wherein the pipe section is arranged on the pump unit or the supply container and the receiving opening is arranged on the other of the pump unit and the supply container so that fluid detergent is allowed to flow from the supply container into the pump unit through the pipe section.

5. Dishwasher machine according to claim 4, wherein the pipe section is directed in such a way, and wherein the pipe section and the receiving opening are positioned in relation to each other in such a way, that when the supply container is attached to the detergent dispenser arrangement, the pipe section is inserted into the receiving opening so as to provide for the fluid communication between the supply container and the pump unit.

6. Dishwasher machine according to claim 1, wherein the pump unit is a peristaltic pump comprising a flexible tube forming a fluid connection between an inlet and an outlet of the pump unit, the pump unit further comprising a rotor provided with a plurality of pump elements arranged to compress the flexible tube and provide a flow of fluid detergent when the rotor rotates.

7. Dishwasher machine according to claim 1, wherein the pump unit is detachably attached to the detergent dispenser arrangement by means of a releasable connection structure, such as a snap-fit connection, a bayonet connection, a screw connection, etc.

8. Dishwasher machine according to claim 1, wherein the fluid communication between the pump unit and the washing chamber is provided by means of a channel through the supply container, wherein a first end of the channel connects to an outlet of the pump unit and a second end of the channel is open to the washing chamber when the supply container is attached to the detergent dispenser arrangement.

9. Dishwasher machine according to claim 1, wherein a spring-biased sealing member is arranged at an outlet of the supply container.

10. Dishwasher machine comprising:

a washing chamber delimited by top, bottom and wall surfaces;

a door that when closed provides one of the delimiting wall surfaces and when open provides access to the washing chamber; and a detergent dispenser arrangement for dispensing fluid detergent, such as liquid or gel detergent, into the washing chamber during operation of the dishwasher machine, wherein the detergent dispenser arrangement is arranged on one of the wall surfaces and comprises a supply container for the fluid detergent and further comprises a transfer mechanism or transferring fluid detergent from the supply container into the washing chamber, and wherein the supply container is adapted to be detachably attachable to the detergent dispenser arrangement, characterized in that the transfer mechanism comprises a pump unit arranged in fluid communication with the washing chamber and the supply container when the supply container is attached to the detergent dispenser arrangement, wherein the supply container is adapted to be detachably attachable to the pump unit so that the supply container can be detached and removed without detaching and removing the pump unit, and wherein the pump unit is detachably attached to the detergent dispenser arrangement so that, at least when the supply container is detached and removed from the detergent dispenser arrangement, the pump unit is accessible for detachment and removal from the detergent dispenser arrangement wherein the transfer mechanism further comprises a pump driver arranged to drive the pump unit so as to transfer fluid detergent from the supply container into the washing chamber and wherein the transfer mechanism comprises a rotatable drive shaft operatively connected to the pump driver and to the pump unit for driving of the pump unit, wherein the drive shaft is arranged to be disconnectable so that the pump unit can be disconnected from the pump driver.

11. Dishwasher machine according to claim 10, wherein the drive shaft comprises a first part connected to the pump driver and a second part connected to the pump unit, and wherein the first and second drive shaft parts are connectable so as to be rotationally fixed to each other.

12. Dishwasher machine according to claim 10, wherein the pump driver comprises an electric motor and, optionally, one or more gear drives.

13. Dishwasher machine comprising:

a washing chamber delimited by top, bottom and wall surfaces;

a door that when closed provides one of the delimiting wall surfaces and when open provides access to the washing chamber; and a detergent dispenser arrangement for dispensing fluid detergent, such as liquid or gel detergent, into the washing chamber during operation of the dishwasher machine, wherein the detergent dispenser arrangement is arranged on one of the wall surfaces and comprises a supply container for the fluid detergent and further comprises a transfer mechanism or transferring fluid detergent from the supply container into the washing chamber, and wherein the supply container is adapted to be detachably attachable to the detergent dispenser arrangement, characterized in that the transfer mechanism comprises a pump unit arranged in fluid communication with the washing chamber and the supply container when the supply container is attached to the detergent dispenser arrangement, wherein the supply container is adapted to be detachably attachable to the pump unit so that the supply container can be detached and removed without detaching and removing the pump unit, and wherein the pump unit is detachably attached to the detergent dispenser arrangement so that, at least when the supply container is detached and removed from the detergent dispenser arrangement, the pump unit is accessible for detachment and removal from the detergent dispenser arrangement wherein the transfer mechanism further comprises a pump driver arranged to drive the pump unit so as to transfer fluid detergent from the supply container into the washing chamber and wherein the pump driver is arranged on a back side of the bottom of the housing compartment, wherein a drive shaft operatively connected to the pump driver and the pump unit extends through the bottom of the housing compartment.

14. Detergent dispenser arrangement for dispensing fluid detergent, such as liquid or gel detergent, into a washing chamber of a dishwashing machine during operation of the dishwasher machine, wherein the detergent dispenser arrangement comprises a housing compartment having a bottom, side walls and an at least partly open side opposite the bottom, wherein the housing compartment is adapted to be arranged in an opening on a wall surface that delimits the washing chamber in the dishwashing machine with the partly open side facing outwards the wall surface and facing inwards the washing chamber, wherein the detergent dispenser arrangement comprises a supply container for the fluid detergent and further comprises a transfer mechanism for transferring fluid detergent from the supply container into the washing chamber, wherein the supply container is adapted to be at least partly inserted into the housing compartment via the partly open side thereof and be detachably attached to the housing compartment, wherein the transfer mechanism comprises a pump unit arranged in fluid communication with the washing chamber and the supply container when the supply container is attached to the housing compartment, wherein the transfer mechanism further comprises a pump driver arranged to drive the pump unit so as to transfer fluid detergent from the supply container into the washing chamber, wherein the supply container is adapted to be detachably attachable to the pump unit so that the supply container can be detached and removed without detaching and removing the pump unit, and wherein the pump unit is detachably attached to the housing compartment so that, at least when the supply container is detached and removed from the housing compartment, the pump unit is accessible for detachment and removal from the detergent dispenser arrangement wherein the pump unit is arranged at the bottom of the housing compartment behind the supply container when the supply container is attached to the housing compartment and wherein the pump driver is arranged on a back side of the bottom of the housing compartment, wherein a drive shaft operatively connected to the pump driver and the pump unit extends through the bottom of the housing compartment.

* * * * *